US009767729B2

(12) United States Patent
Shin

(10) Patent No.: US 9,767,729 B2
(45) Date of Patent: Sep. 19, 2017

(54) ORGANIC LIGHT EMITTING DISPLAY DEVICE AND DRIVING METHOD THEREOF

(71) Applicant: Samsung Display Co., Ltd., Yongin (KR)

(72) Inventor: Byung-Hyuk Shin, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 146 days.

(21) Appl. No.: 14/670,930

(22) Filed: Mar. 27, 2015

(65) Prior Publication Data

US 2015/0356897 A1 Dec. 10, 2015

(30) Foreign Application Priority Data

Jun. 10, 2014 (KR) ..... 10-2014-0070311

(51) Int. Cl.
*G09G 3/32* (2016.01)
*G09G 3/3233* (2016.01)

(52) U.S. Cl.
CPC ... *G09G 3/3233* (2013.01); *G09G 2300/0861* (2013.01); *G09G 2320/0295* (2013.01); *G09G 2320/043* (2013.01)

(58) Field of Classification Search
CPC ..... G09G 3/3233; G09G 2300/0861; G09G 2320/0295; G09G 2320/043
See application file for complete search history.

(56) References Cited

U.S. PATENT DOCUMENTS 8,589,100 B2 11/2013 Chaji et al.
8,599,224 B2 12/2013 Yoo et al.
8,624,805 B2 1/2014 McCreary
2007/0128583 A1* 6/2007 Miyazawa ..... G09G 3/3233 434/433
2011/0316838 A1* 12/2011 Ahn ..... G09G 3/3225 345/211

FOREIGN PATENT DOCUMENTS

KR 10-2009-0131786 12/2009
KR 10-2011-0039773 4/2011

* cited by examiner

*Primary Examiner* — Sahlu Okebato
(74) *Attorney, Agent, or Firm* — H.C. Park & Associates, PLC

(57) ABSTRACT

An organic light emitting display device includes pixels divided by scan lines and data lines, and including first transistors for controlling the amount of current flowing from a first power source to a second power source through organic light emitting diodes, first feedback lines and second feedback lines formed in parallel to the data lines, control lines formed in parallel to the scan lines, and a sensing unit configured to extract at least one of voltage drop of the first power source and deterioration information of the first transistor from the pixels via the first feedback lines and the second feedback lines.

18 Claims, 4 Drawing Sheets

ORGANIC LIGHT EMITTING DISPLAY DEVICE AND DRIVING METHOD THEREOF

CROSS-REFERENCE TO RELATED APPLICATION

This application claims priority from and the benefit of Korean Patent Application No. 10-2014-0070311, filed on Jun. 10, 2014, which is hereby incorporated by reference for all purposes as if fully set forth herein.

BACKGROUND

Field

Exemplary embodiments relate to an organic light emitting display device, and a driving method thereof.

Discussion of the Background

With the development of information technology, the importance of a display device which provides a connection medium between a user and information has been emphasized. In this respect, the use of a Flat Panel Display (FPD), such as a Liquid Crystal Display Device (LCD), an Organic Light Emitting Display Device (OLED), and a Plasma Display Panel (PDP), has increased.

Among the FPDs, an organic light emitting display device displays an image by using an organic light emitting diode which emits light by utilizing the recombination of electrons and holes, and has an advantage in that the organic light emitting display device has a fast response speed and low power consumption.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide an organic light emitting display device capable of displaying a uniform image by compensating deterioration of a driving transistor, and a driving method thereof.

Additional aspects will be set forth in the detailed description which follows, and, in part, will be apparent from the disclosure, or may be learned by practice of the inventive concept.

Exemplary embodiment of the present invention provides an organic light emitting display device. The organic light emitting display device may include pixels arranged at crossing regions of scan lines and data lines, in which the pixels include first transistors controlling the amount of current flowing from a first power source to a second power source through organic light emitting diodes, first feedback lines and second feedback lines formed in parallel to the data lines, control lines formed in parallel to the scan lines, and a sensing unit configured to extract at least one of voltage drop information of the first power source and deterioration information of the first transistor, in which the sensing unit extracts at least one of voltage the drop information and the deterioration information from the pixels through the first feedback lines and the second feedback lines.

Each of the pixels may includes the organic light emitting diode, a second transistor connected to a first electrode of the first transistor and an $i^{th}$ first feedback line (i is an integer), and turning on when a control signal is supplied to a $j^{th}$ control line (j is an integer), in which the first electrode of the first transistor is connected to the first power source, and a third transistor connected to a second electrode of the first transistor and an $i^{th}$ second feedback line, and turning on when the control signal is supplied to the $j^{th}$ control line, in which the second electrode of the first transistor is connected to an anode electrode of the organic light emitting diode.

The sensing unit may extract the deterioration information of the first transistor by using a difference value between a voltage supplied to the $i^{th}$ first feedback line and a voltage supplied to the $i^{th}$ second feedback line.

The pixels may store a data signal of the same gray level during a period of extracting the deterioration information.

The pixels may store a data signal corresponding to a black gray level during a period of extracting the deterioration information.

The sensing unit may extract voltage drop information of the first power source corresponding to a voltage supplied from the $i^{th}$ first feedback line.

The pixels may store a data signal corresponding to an image desired to display during a period of extracting the voltage drop information.

Each of the pixels may further include a fourth transistor connected to the data line and a gate electrode of the first transistor, and turning on when a scan signal is supplied to a $j^{th}$ scan line, and a storage capacitor connected to a first electrode and the gate electrode of the first transistor.

One frame period may be divided into a first period to a third period, and the organic light emitting display device may further include a scan driver configured to sequentially supply the scan signal to the scan lines during the first period and the second period.

The organic light emitting display device may further include a data driver configured to supply a data signal corresponding to an image desired to display during the first period, a first reference voltage within a voltage range of the data signal during the second period, and a second reference voltage within the voltage range of the data signal during the third period, to the data lines.

A voltage level of the second power source may be set as a high voltage so that the pixels do not emit light during the third period.

The organic light emitting display device may further include a control line driver configured to supply a first control signal to a control line connected to a pixel from which the voltage drop information is to be extracted during the first period, and a second control signal to a control line connected to a pixel from which the deterioration information is to be extracted during the third period.

The organic light emitting display device may further include a control line driver configured to supply the control signal to the $j^{th}$ control line to synchronize with the scan signal supplied to a $j+1^{th}$ scan line during the first period, and supply the control signal to the $j^{th}$ control line during the third period.

The sensing unit may include a first analog digital converter connected to each of the first feedback lines, a second analog digital converter connected to each of the second feedback lines, and a controller configured to store the deterioration information and the voltage drop information supplied from the first analog digital converter and the second analog digital converter in a memory.

The organic light emitting display device may further include a timing controller configured to change data by using the information stored in the memory to compensate deterioration of the driving transistor and the voltage drop of the first power source.

Exemplary embodiment of the present invention also provides a method of driving an organic light emitting display device, the method including, storing reference information corresponding to a voltage difference between a first electrode and a second electrode of a driving transistor included in each pixels before the pixels are driven, extracting deterioration information corresponding to the voltage difference between the first electrode and the second electrode of the driving transistor included in each pixels while the pixels are driven, comparing the reference information and the deterioration information, and changing data to compensate deterioration of the driving transistor in accordance with a result of the comparison.

The pixels may store a data signal of the same gray level during a period of extracting the deterioration information.

The driving transistor may control the amount of current flowing from a first power source to a second power source through an organic light emitting diode.

The method may further include extracting voltage drop information of the first power source by measuring a voltage applied to a first electrode of the first driving transistor included in each of the pixels.

The pixels may store a data signal corresponding to an image desired to display during a period of extracting the deterioration information.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION OF THE ILLUSTRATED EMBODIMENTS

Figure 1:
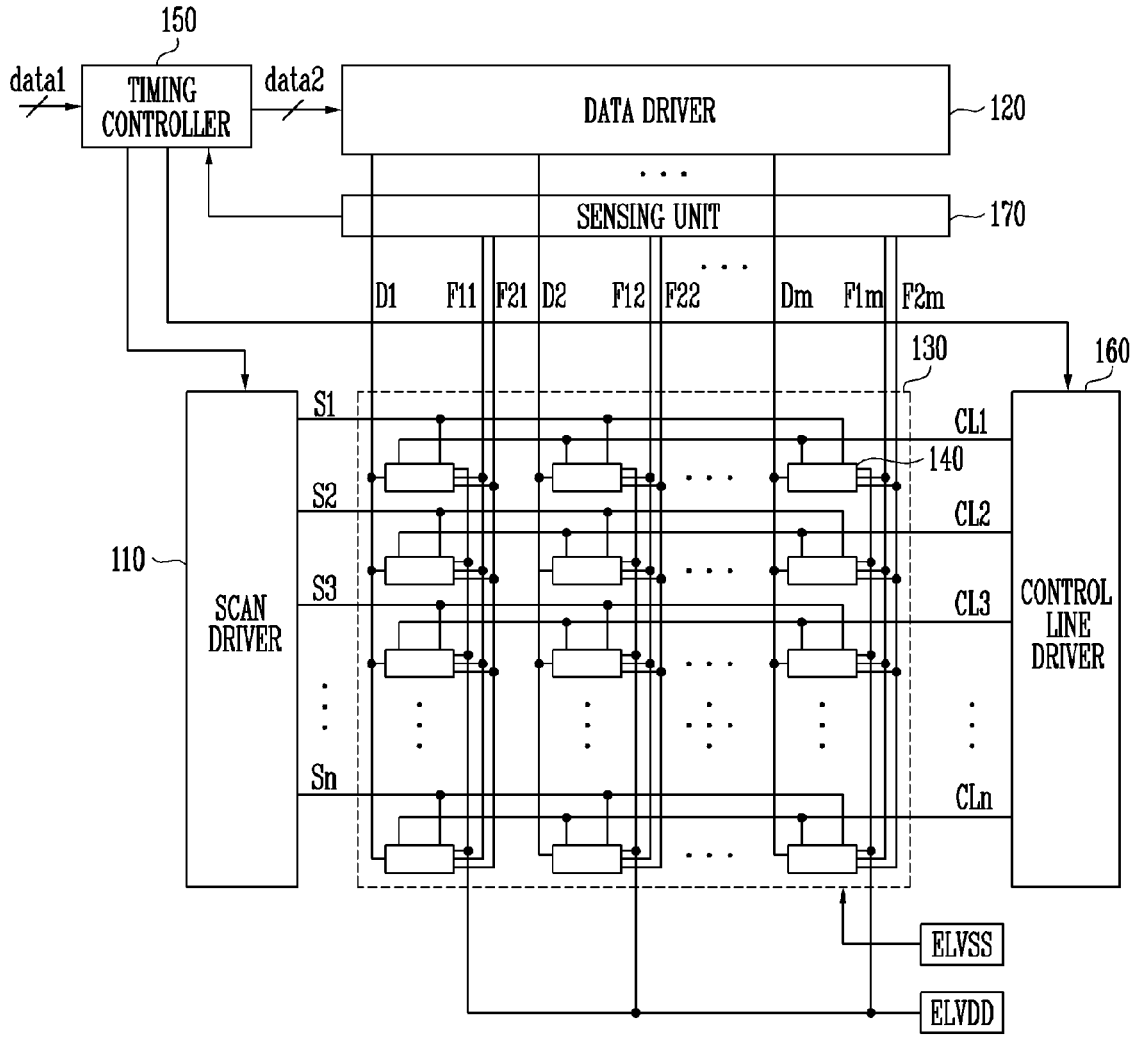
FIG. 1 is a diagram illustrating an organic light emitting display device according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a diagram illustrating an organic light emitting display device according to an exemplary embodiment of the present invention.

Referring to FIG. 1, an organic light emitting display device according to an exemplary embodiment of the present invention includes a pixel unit 130 including pixels 140 positioned in regions divided by scan lines (S1 to Sn) and data lines (D1 to Dm), a scan driver 110 for driving the scan lines (S1 to Sn), a data driver 120 for driving the data lines (D1 to Dm), a control line driver 160 for driving control lines (CL1 to CLn) formed in parallel to the scan lines (S1 to Sn), and a timing controller 150 for controlling the scan driver 110, the data driver 120, and the control line driver 160.

Further, the organic light emitting display device according to an exemplary embodiment of the present invention includes a sensing unit 170 for extracting deterioration information of a driving transistor included in each of the pixels 140 and voltage drop information of a first power source (ELVDD) by using first feedback lines (F11 to F1*m*) and second feedback lines (F21 to F2*m*) formed in parallel to the data lines (D1 to Dm).

The pixel unit 130 includes the pixels 140 positioned in the regions divided by the scan lines (S1 to Sn) and the data lines (D1 to Dm). Each of the pixels 140 includes the driving transistor for controlling the amount of current flowing from the first power source (ELVDD) to a second power source (ELVSS) via an organic light emitting diode (not shown) corresponding to the data signal.

Figure 4:
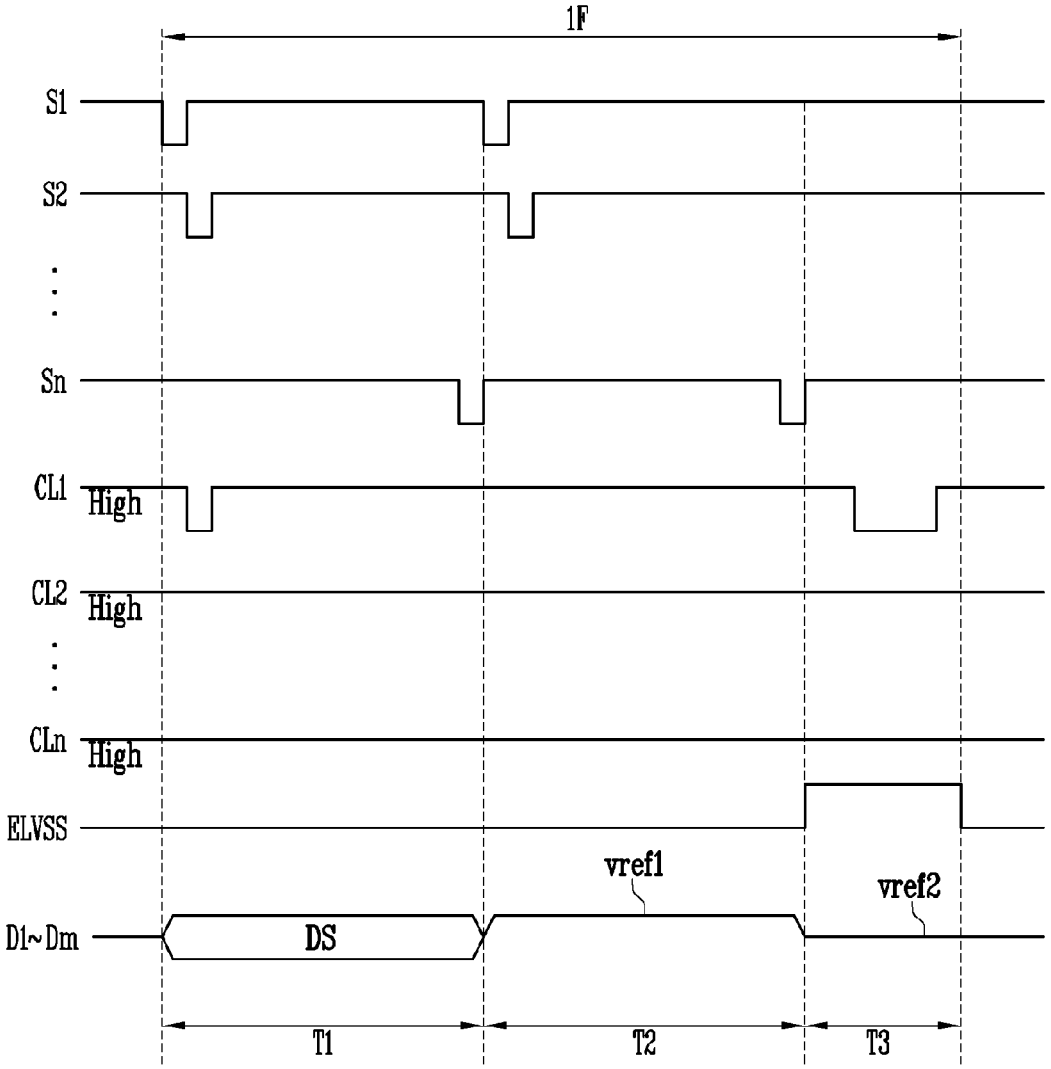
FIG. 4 is a waveform diagram illustrating a driving waveform according to the exemplary embodiment of the present invention.

The scan driver 110 supplies a scan signal to the scan lines (S1 to Sn). For example, the scan driver 110 may sequentially supply the scan signal to the scan lines (S1 to Sn) during a first period (T1) and a second period (T2) in one frame period as illustrated in FIG. 4.

The data driver 120 may be synchronized to the scan signal to supply the data signal to the data lines (D1 to Dm). For example, the data driver 120 supplies the data signal corresponding to an image desired to be implemented during the first period (T1) in one frame, and supplies the same data signal to all of the pixels 140 during the second period (T2). Here, the same data signal supplied during the second period (T2) may be set as the data signal corresponding to a black gray level.

The control line driver 160 supplies the control signal to an $i^{th}$ first control line (CLi, where i is an integer) among the control lines (CL1 to CLn) for the first period (T1) and a $i^{th}$ third period (T3) of one frame. The control signal supplied to the $i^{th}$ first control line for the first period (T1) overlaps the scan signal supplied to an $i+1^{th}$ scan line (Si+1). For example, the control signal supplied to a current horizontal line may overlap the scan signal supplied to a next horizontal line.

The sensing unit 170 extracts the voltage drop information of the first power source (ELVDD) from each of the pixels 140 positioned in the $i^{th}$ horizontal line in response to the control signal supplied to the $i^{th}$ first control line (CLi) for the first period (T1) of one frame. Further, the sensing unit 170 extracts the deterioration information of the driving transistor from each of the pixels 140 positioned in the $i^{th}$ horizontal line in response to the control signal supplied to the $i^{th}$ first control line (CLi) for the third period (T3) of one frame. The process of extracting voltage drop information and deterioration information is further described in detail below.

The timing controller 150 controls the scan driver 110, the data driver 120, and the control line driver 160. Further, the timing controller 150 receives the deterioration information and the voltage drop information from the sensing unit 170, and changes first data (data1) in accordance with the received information to generate second data (data 2). The second data (data2) may be configured to compensate the deterioration of the driving transistor and the voltage drop of the first power source (ELVDD).

While the structure of the organic light emitting display device has been described above, the embodiments of the present invention are not limited thereto. For example, instead of structuring the scan driver 110 and the control line driver 160 as separate drivers as illustrated in FIG. 1, the control line driver 160 may be removed, and the scan driver 110 may supply the control signal to the control lines (CL1 to CLn).

Figure 2:
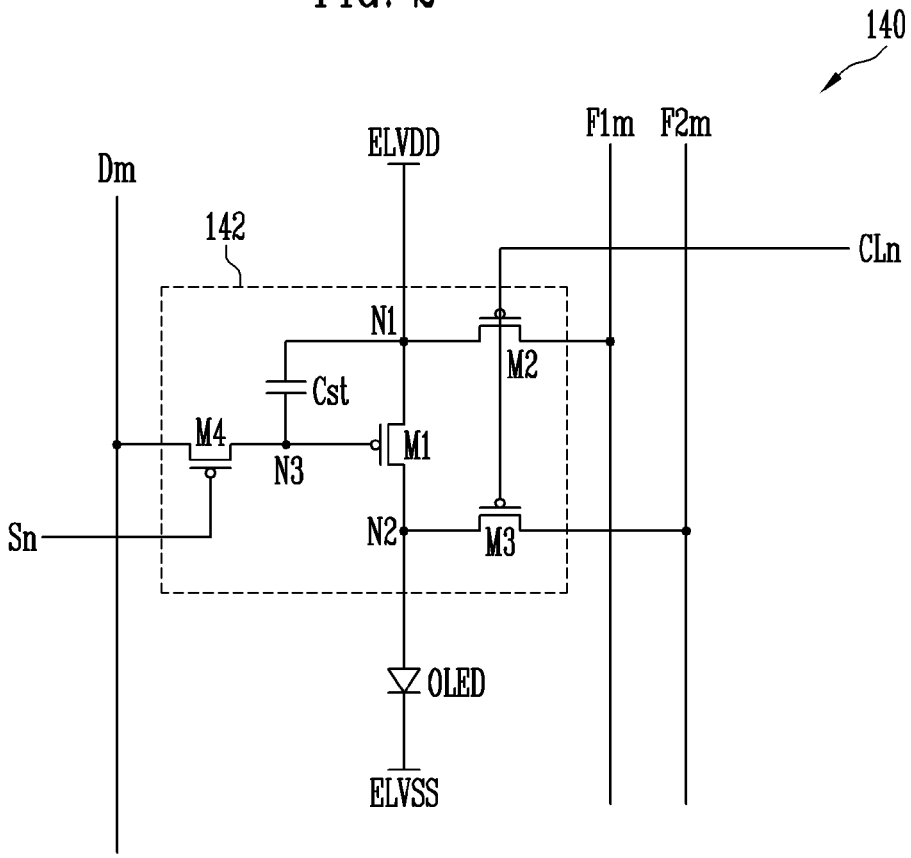
FIG. 2 is a diagram illustrating a pixel according to the exemplary embodiment of the present invention.

FIG. 2 is a diagram illustrating the pixel according to the exemplary embodiment of the present invention. For convenience of the description, FIG. 2 illustrates a pixel connected to an $m^{th}$ data line (Dm) and an $n^{th}$ scan line (Sn).

Referring to FIG. 2, the pixel (as shown in FIG. 1, 140) according to the exemplary embodiment of the present invention includes an organic light emitting diode (OLED) and a pixel circuit 142 for controlling the amount of current supplied to the organic light emitting diode (OLED).

An anode electrode of the organic light emitting diode (OLED) is connected to the pixel circuit 142, and a cathode electrode is connected to the second power source (ELVSS). The organic light emitting diode (OLED) generates light with predetermined luminance in response to the current supplied from the pixel circuit 142.

The pixel circuit 142 controls the amount of current flowing from the first power source (ELVDD) to a second power source (ELVSS) through the organic light emitting diode (OLED) in response to the data signal. To this end, the pixel circuit 142 may include first to fourth transistors (M1 to M4), and a storage capacitor (Cst).

A first electrode of the first transistor (M1, driving transistor) is connected to the first power source (ELVDD), and a second electrode thereof is connected to the anode electrode of the organic light emitting diode (OLED). Further, a gate electrode of the first transistor (M1) is connected to a third node (N3). The first transistor (M1) controls the amount of current supplied to the organic light emitting diode (OLED) corresponding to the voltage applied to the third node (N3).

The second transistor (M2) is connected to the first node (N1) and a first feedback line (F1*m*). More specifically, the first node (N1) is the first electrode of the first transistor (M1). Further, a gate electrode of the second transistor (M2) is connected to the control line (CLn). The second transistor (M2) is turned on when the control signal is supplied to the control line (CLn) to electrically connect the first node (N1) and the first feedback line (F1*m*).

The third transistor (M3) is connected to the second node (N2) and a second feedback line (F2*m*). More specifically, the second node (N2) is the second electrode of the first transistor (M1). Further, a gate electrode of the third transistor (M3) is connected to the control line (CLn). The third transistor (M3) is turned on when the control signal is supplied to the control line (CLn) to electrically connect the second node (N2) and the second feedback line (F2*m*).

The fourth transistor (M4) is connected between the data line (Dm) and the third node (N3). Further, a gate electrode of the fourth transistor (M4) is connected to the scan line (Sn). The fourth transistor (M4) is turned on when the scan signal is supplied to the scan line (Sn) to electrically connect the data line (Dm) and the third node (N3).

The storage capacitor (Cst) is connected between the first node (N1) and the third node (N3). The storage capacitor (Cst) stores a voltage corresponding to the data signal.

While the structure of the pixel circuit 142 of an organic light emitting diode display has been described above, the embodiments of the present invention are not limited thereto. For example, the exemplary embodiment of the present invention includes the first to third transistors (M1 to M3), and other configurations of the pixel circuit 142 may be achieved with various disclosed forms.

Figure 3:
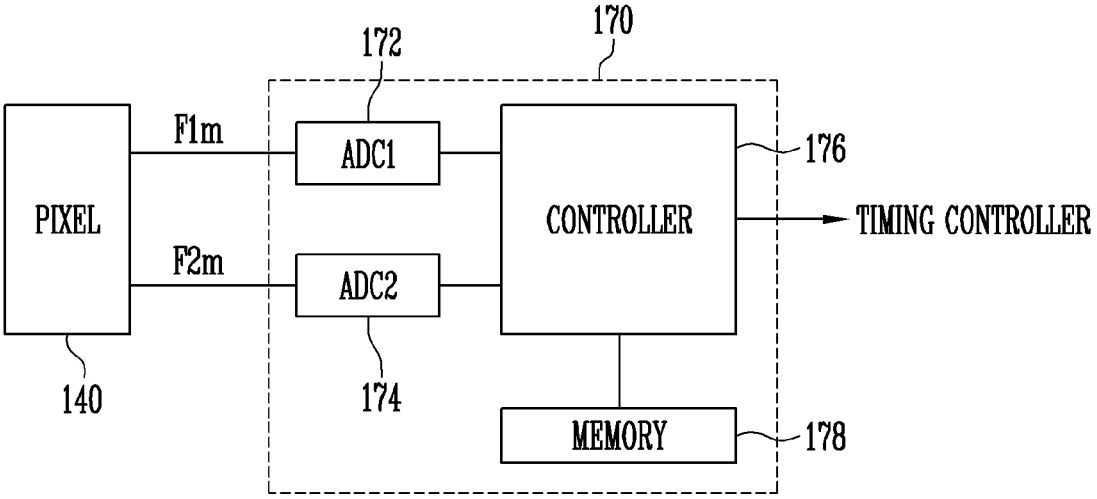
FIG. 3 is a diagram illustrating a sensing unit illustrated in FIG. 1 according to the exemplary embodiment of the present invention.

FIG. 3 is a diagram illustrating the sensing unit illustrated in FIG. 1 according to the exemplary embodiment of the present invention. For convenience of the description, an $m^{th}$ channel is illustrated in FIG. 3.

Referring to FIG. 3, the sensing unit 170 according to the exemplary embodiment of the present invention includes a first analog digital converter (ADC1) 172, a second analog digital converter (ADC2) 174, a controller 176, and a memory 178. Here, the controller 176 and the memory 178 may be commonly connected to all of the channels. For example, one or more controllers 176 and memories 178 may be installed in the sensing unit 170.

The ADC1 172 is positioned between the first feedback line (F1*m*) and the controller 176. The ADC1 172 converts an analog voltage supplied from the first feedback line (F1*m*) into a first digital value and supplies the first digital value to the controller 176. The ADC1 172 generates a 'first' first digital value during the first period (T1) of one frame, and a 'second' first digital value during the third period (T3).

The ADC2 174 is positioned between the second feedback line (F2*m*) and the controller 176. The ADC2 174 converts an analog voltage supplied from the second feedback line (F2*m*) into a second digital value during the third period (T3) of one frame, and then supplies the second digital value to the controller 176.

The first digital value and the second digital value are stored in the memory 178. The memory 178 further stores reference information corresponding to a difference between the first electrode and the second electrode of the driving transistor prior to the deterioration occurs. For example, reference information may be configured as a value corresponding to a difference between the first digital value and the second digital value extracted from each pixel prior to the release of the display panel.

The controller 176 stores the first digital value supplied from the ADC1 172 and the second digital value supplied from the ADC2 174 in the memory 178. Here, the controller 176 extracts voltage drop information of the first power source (ELVDD) by using the 'first' first digital value, and supplies the extracted information to the timing controller 150. Further, the controller 176 may extract deterioration information of the driving transistor by using the 'second' first digital value and the second digital value. For example, the controller 176 may compare a difference between the 'second' first digital value and the second digital value with the reference information, and then supply deterioration information corresponding to a result of the comparison to the timing controller 150.

FIG. 4 is a waveform diagram illustrating a driving waveform according to the exemplary embodiment of the present invention. FIG. 4 illustrates a process of extracting deterioration information of the driving transistor of each pixels positioned in the first horizontal line and voltage drop information of the first power source (ELVDD).

Referring to FIG. 4, the scan signal is sequentially supplied to the scan lines (S1 to Sn) for the first period (T1) of one frame (1F). Then, the data signal (DS) is supplied to the data lines (D1 to Dm) so as to be synchronized to the scan signal.

When the scan signal is sequentially supplied to the scan lines (S1 to Sn), the fourth transistor (M4) included in each pixel (as shown in FIG. 1, 140) is sequentially turned on in horizontal line basis. Then, when the data signal (DS) is supplied to be synchronized to the scan signal, the data signal (DS) corresponding to a desired gray level is supplied in horizontal line basis.

Accordingly, a voltage corresponding to the data signal is charged in the storage capacitor (Cst) of each pixels 140, and then each of the pixels 140 generates light corresponding to the desired gray level.

Meanwhile, to extract the voltage drop information of the first power source (ELVDD) of the pixels positioned in the first horizontal line, the control signal is supplied to the first control line (CL1) so as to be synchronized to the scan signal supplied to a second scan line (S2). When the control signal is supplied to the first control line (CL1), the second transistor (M2) and the third transistor (M3) included in each pixels positioned in the first horizontal line are turned on.

When the second transistor (M2) is turned on, the first node (N1) of each pixels positioned in the first horizontal line is electrically connected to the first feedback line (F11 to F1*m*). Then, the ADC1 (as shown in FIG. 3, 172) formed in each channel converts the voltage of the first node (N1) supplied from the first feedback line (F11 to F1*m*) into the 'first' first digital value and supplies the 'first' first digital value to the controller (as shown in FIG. 3, 176). Then, the controller 176 stores the 'first' first digital value in the memory (as shown in FIG. 3, 178).

Figure 5A:
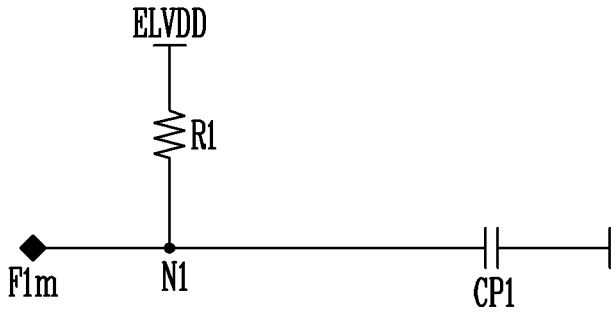
FIGS. 5A and 5B are diagrams illustrating a process of extracting voltage drop information of the first power source and deterioration information of the driving transistor according to the exemplary embodiment of the present invention.

At this stage, the voltage applied to the first node (N1) of each pixels is set as the voltage of the first power source (ELVDD). The voltage of the first power source (ELVDD) applied to the first node (N1) is dropped by a predetermined value as illustrated in FIG. 5A. Accordingly, the voltage applied to the first node (N1) includes the voltage drop information of the first power source (ELVDD). In FIG. 5A, a factor causing the voltage drop by a load is illustrated as a first resistance (R1), and capacitance of the first feedback line (F1*m*) is illustrated as Cp1.

The scan signal is sequentially supplied to the scan lines (S1 to Sn) for the second period (T2) of one frame (1F), and the data signal with the same gray level is supplied to the data lines (D1 to Dm) corresponding to the scan signal. Here, the data signal with the same gray level supplied to the second period (T2) may be set as the data signal corresponding to a black gray level. For convenience of the description, it is assumed that the data signal corresponding to the black gray level is set as a first reference voltage (Vref1).

When the scan signal is sequentially supplied to the scan lines (S1 to Sn) for the second period (T2), and the data signal with the black gray level is supplied to the data lines (D1 to Dm), a voltage corresponding to the first reference voltage (Vref1) is charged in the storage capacitor (Cst) included in each of the pixels 140. Accordingly, the pixels 140 are sequentially set to be in a non-emission state after the second period (T2).

After the pixels 140 are set to be in the non-emission state, the control signal is supplied to the first control line (CL1) during the third period (T3) of one frame (1F). During the third period (T3), the voltage of the second power source (ELVSS) may be increased so that the pixels may not emit light stably. For example, the second power source (ELVSS) is set to a high voltage, at which the pixels 140 does not emit light during the third period (T3). Then, the data driver (as shown in FIG. 1, 120) supplies a specific voltage, for example, the second reference voltage (Vref2), within the data signal to the data lines (D1 to Dm) for the third period (T3). When the same voltage (Vref2) is supplied to the data lines (D1 to Dm) for the third period (T3), it is possible to prevent the voltages of the pixels 140 from being unevenly changed by a parasitic capacitor.

When the control signal is supplied to the first control line (CL1), the second transistor (M2) and the third transistor (M3) included in each of the pixels 140 positioned in the first horizontal line are turned on.

When the second transistor (M2) is turned on, the first node (N1) of each pixels positioned in the first horizontal line is electrically connected to the first feedback line (F11 to F1*m*). Then, the ADC1 (as shown in FIG. 3, 172) formed in each channel converts the voltage of the first node (N1) supplied from the first feedback line (F11 to F1*m*) into the 'second' first digital value, and supplies the 'second' first digital value to the controller (as shown in FIG. 3, 176). Then, the controller 176 stores the 'second' first digital value in the memory (as shown in FIG. 3, 178).

When the third transistor (M3) is turned on, the second node (N2) of each pixels positioned in the first horizontal line is electrically connected to the second feedback line (F21 to F2*m*). Then, the ADC2 (as shown in FIG. 3, 174) formed in each channel converts the voltage of the second node (N2) supplied from the second feedback line (F21 to F2*m*) into the second digital value, and supplies the second digital value to the controller 176. Then, the controller 176 stores the second digital value in the memory 178.

Figure 5B:
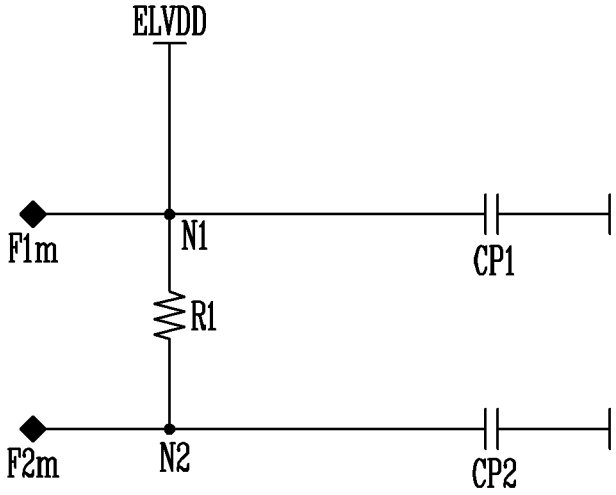

FIG. 5B illustrates a diagram of the voltage of the first node (N1) and the second node (N2) during the third period (T3). In FIG. 5B, a second resistance (R2) positioned between the first node (N1) and the second node (N2) equivalently represents the first transistor (M1). Here, a resistance value of the second resistance (R2) is changed corresponding to deterioration of the first transistor (M1). Accordingly, it is possible to extract the deterioration information of the first transistor (M1) by a voltage difference between the first node (N1) and the second node (N2). In FIG. 5B, the capacitance of the first feedback line (F1*m*) is illustrated as Cp1, and capacitance of the second feedback line (F2*m*) is illustrated as Cp2.

When the control signal is sequentially supplied to the control lines (CL1 to CLn) for each frame period, deterioration information and voltage drop information of each pixels 140 in the pixel unit (as shown in FIG. 1, 130) are stored in the memory unit 178.

The controller 176 compares the reference information with the voltage difference between the 'second' first digital value and the second digital value. Then the controller supplies deterioration information corresponding to a result of the comparison and voltage drop information of pixels corresponding to the 'first' first digital value to the timing controller (as shown in FIG. 1, 150). The timing controller 150 then generates the second data (data2) by changing the first data (data1) to compensate the voltage drop and the deterioration.

While a driving waveform for extracting the deterioration information and the voltage drop information has been described above, the embodiments of the present invention are not limited thereto. For example, the controller may not supply the control signal to the control lines (CL1 to CLm) during the period for which the deterioration information and the voltage drop information are not extracted, but alternatively a frame period may be configured to implement a predetermined image in response to a desired data signal, such as the first period (T1) of one frame.

Further, while a pixel unit structure with common connection between the first power source (ELVDD) and the pixels 140 has been described above, the embodiments of the present invention are not limited thereto. For example, separate first power sources (ELVDD) may be supplied to the red pixel, the green pixel, and the blue pixel, respectively. Further, the embodiments of the present invention may also be applied to a case where the red pixel, the green pixel, and the blue pixel are disposed in the unit of the horizontal line, or where the red pixel, the green pixel, and the blue pixel are disposed in the unit of a vertical line.

Similarly, while the transistors discussed above have PMOS structure, the embodiments of the present invention are not limited thereto. More specifically, the transistors may be structured as NMOS type.

In the exemplary embodiments of the present invention, the organic light emitting diode (OLED) may generate red, green, blue, or white light depending on the amount of current. When the organic light emitting diode (OLED) generates white light, it is possible to implement a color image by using a separate color filter and the like.

The organic light emitting display device includes the plurality of pixels arranged in the matrix form in crossing portions of the plurality of data lines, the plurality of scan lines, and the plurality of power supply lines. The pixels generally include the organic light emitting diodes and the driving transistors for controlling the amount of current flowing to the organic light emitting diodes. The driving transistor controls luminance of light generated by the organic light emitting diode while controlling the amount of current flowing to the second power source from the first power source via the organic light emitting diode.

The driving transistor of the organic light emitting display device deteriorates according to time, thereby failing to display a uniform image. Further, the voltage drop (Ir-drop) of the first power source is generated in accordance with a position of the panel, thereby failing to display a uniform image.

According to the organic light emitting display device according to the exemplary embodiment of the present invention and the driving method thereof, the voltage drop information of the first power source of the first power source and the deterioration information of the driving transistor are extracted from each of the pixels. Then, it is possible to change data so that the voltage drop and the deterioration of the driving transistor of each of the pixels may be compensated, thereby displaying an image with desired luminance.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. An organic light emitting display device, comprising:

pixels arranged at crossing regions of scan lines and data lines, each of the pixels comprising:

a first transistor configured to control an amount of current flowing from a first power source to a second power source through an organic light emitting diode;

a first feedback line and a second feedback line formed in parallel to a corresponding data line; and a control line formed in parallel to a corresponding scan line; and a sensing unit configured to extract at least one of voltage drop information of the first power source and deterioration information of the first transistor from the pixels through the first and second feedback lines, wherein the pixels store a data signal of the same gray level during a period of extracting the deterioration information of the first transistor.

2. The organic light emitting display device of claim 1, wherein each of the pixels further comprises:

the organic light emitting diode;

a second transistor connected to a first electrode of the first transistor and the first feedback line, and turning on when a control signal is supplied to the control line, wherein the first electrode of the first transistor is connected to the first power source; and a third transistor connected to a second electrode of the first transistor and the second feedback line, and turning on when the control signal is supplied to the control line, wherein the second electrode of the first transistor is connected to an anode electrode of the organic light emitting diode.

3. The organic light emitting display device of claim 2, wherein the sensing unit extracts the deterioration information of the first transistor by using a difference value between a voltage supplied to the first feedback line and a voltage supplied to the second feedback line.

4. The organic light emitting display device of claim 3, wherein the pixels store a data signal corresponding to a black gray level during a period of extracting the deterioration information.

5. The organic light emitting display device of claim 2, wherein the sensing unit extracts the voltage drop information of the first power source corresponding to a voltage supplied from the first feedback line.

6. The organic light emitting display device of claim 5, wherein the pixels store a data signal corresponding to an image desired to display during a period of extracting the voltage drop information.

7. The organic light emitting display device of claim 2, wherein each of the pixels further comprises:

a fourth transistor connected to the data line and a gate electrode of the first transistor, and turning on when a scan signal is supplied to the scan line; and a storage capacitor connected to the first electrode and the gate electrode of the first transistor.

8. The organic light emitting display device of claim 2, wherein:

one frame period is divided into a first period, a second period, and a third period; and the organic light emitting display device further comprises a scan driver configured to sequentially supply the scan signal to the scan lines during the first period and the second period.

9. The organic light emitting display device of claim 8, further comprising:

a data driver configured to supply a data signal corresponding to an image desired to display during the first period, a first reference voltage within a voltage range of the data signal during the second period, and a second reference voltage within the voltage range of the data signal during the third period, to the data lines.

10. The organic light emitting display device of claim 8, wherein a voltage level of the second power source is set as a high voltage so that the pixels do not emit light during the third period.

11. The organic light emitting display device of claim 8, further comprising:

a control line driver configured to supply a first control signal to the control lines connected to corresponding pixels from which the voltage drop information is to be extracted during the first period, and a second control signal to the control lines connected to corresponding pixels from which the deterioration information is to be extracted during the third period.

12. The organic light emitting display device of claim 8, further comprising:

a control line driver configured to supply the control signal to the control line to synchronize with the scan signal supplied to an adjacent scan line during the first period, and supply the control signal to the control line during the third period.

13. The organic light emitting display device of claim 1, wherein the sensing unit comprises:

a first analog digital converter connected to each of the first feedback lines;

a second analog digital converter connected to each of the second feedback lines; and a controller configured to store the deterioration information and the voltage drop information supplied from the first analog digital converter and the second analog digital converter in a memory.

14. The organic light emitting display device of claim 13, further comprising:

a timing controller configured to change data by using the information stored in the memory to compensate deterioration of the first transistor and the voltage drop of the first power source.

15. A method of driving an organic light emitting display device, comprising:

storing reference information corresponding to a voltage difference between a first electrode and a second electrode of a driving transistor included in each pixels before the pixels are driven;

extracting deterioration information corresponding to the voltage difference between the first electrode and the second electrode of the driving transistor included in each pixels while the pixels are driven; and comparing the reference information and the deterioration information, and changing data to compensate deterioration of the driving transistor in accordance with a result of the comparison, wherein the pixels store a data signal of the same gray level during a period of extracting the deterioration information.

16. The method of claim 15, wherein the driving transistor controls an amount of current flowing from a first power source to a second power source through an organic light emitting diode.

17. The method of claim 16, further comprising:

extracting voltage drop information of the first power source by measuring a voltage applied to the first electrode of the first driving transistor included in each of the pixels.

18. The method of claim 17, wherein the pixels store a data signal corresponding to an image desired to display during a period of extracting the deterioration information.

* * * * *